US012679508B2

(12) United States Patent
Cahay et al.

(10) Patent No.: US 12,679,508 B2
(45) Date of Patent: Jul. 14, 2026

(54) METHOD FOR INSTALLING AT LEAST ONE MOORING LINE OF A FLOATING INSTALLATION IN A BODY OF WATER AND ASSOCIATED FLOATING INSTALLATION

(71) Applicant: TECHNIP ENERGIES FRANCE, Nanterre Cedex (FR)

(72) Inventors: Marc Cahay, Villemomble (FR); Coste Francois, Alfortville (FR)

(73) Assignee: TECHNIP ENERGIES FRANCE, Nanterre Cedex (FR)

( * ) Notice: Subject to any disclaimer, the term of this patent is extended or adjusted under 35 U.S.C. 154(b) by 759 days.

(21) Appl. No.: 18/017,404

(22) PCT Filed: Jul. 21, 2021

(86) PCT No.: PCT/EP2021/070410

§ 371 (c)(1),
(2) Date: Jan. 21, 2023

(87) PCT Pub. No.: WO2022/018147

PCT Pub. Date: Jan. 27, 2022

(65) Prior Publication Data

US 2023/0264789 A1 Aug. 24, 2023

(30) Foreign Application Priority Data

Jul. 22, 2020 (FR) ..... FR2007698

(51) Int. Cl.
*B63B 21/26* (2006.01)
*B63B 21/00* (2006.01)
(Continued)

(52) U.S. Cl.
CPC ..... *B63B 21/26* (2013.01); *B63B 21/20* (2013.01); *B63B 21/50* (2013.01); *B63B 2021/003* (2013.01); *B63B 2021/267* (2013.01)

(58) Field of Classification Search
CPC ..... B63B 21/26; B63B 21/20; B63B 21/50; B63B 2021/003; B63B 2021/267; Y02E 10/727
See application file for complete search history.

(56) References Cited

U.S. PATENT DOCUMENTS 4,727,819 A * 3/1988 Pollack ..... B63B 21/50 175/7
5,505,646 A * 4/1996 Poldervaart ..... B63B 22/02 441/3

(Continued)

FOREIGN PATENT DOCUMENTS

CN 107253512 A 10/2017
CN 109398613 B 10/2019

(Continued)

OTHER PUBLICATIONS

PCT International Search Report and Written Opinion dated Oct. 18, 2021, issued during the prosecution of corresponding PCT International Patent Application No. PCT/EP2021/070410.

(Continued)

*Primary Examiner* — Anthony D Wiest
(74) *Attorney, Agent, or Firm* — Troutman Pepper Locke LLP; Gabrielle L. Gelozin

(57) ABSTRACT

The method comprises installing at least one lower section of a mooring line at the bottom of the body of water; trapping the lower section in the ground; connecting an upper unit of the floating installation to the mooring line. The lower section being constituted by a chain, the chain defining, after the connection of the upper unit, a lower end of the mooring line not provided with a mooring point pre-mounted on the mooring line, in particular an anchor or pile.

19 Claims, 9 Drawing Sheets

(51) Int. Cl.
*B63B 21/20* (2006.01)
*B63B 21/50* (2006.01)

(56) References Cited

U.S. PATENT DOCUMENTS

| | | | |
|---|---|---|---|
| 5,992,060 | A | 11/1999 | Treu et al. |
| 6,122,847 | A | 9/2000 | Treu et al. |
| 2007/0017429 | A1 | 1/2007 | Riggs |
| 2007/0240624 | A1 | 10/2007 | Collee et al. |

FOREIGN PATENT DOCUMENTS

| | | | |
|---|---|---|---|
| FR | 2452418 | A1 | 10/1980 |
| GB | 2544287 | A | 5/2017 |
| JP | S53107257 | A | 9/1978 |
| JP | 2007505784 | A | 3/2007 |
| JP | 5192396 | B2 | 5/2013 |
| WO | 2005025978 | A2 | 3/2005 |

OTHER PUBLICATIONS

Japanese Office Action dated May 20, 2025, issued during the prosecution of JP 2023-504443.
Japanese Office Action issued during the prosecution of Japanese Patent Application No. JP 2023-504443.
Office Action dated Jan. 20, 2026, issued in corresponding Korean Patent Application No. 10-2023-7002712.

* cited by examiner

METHOD FOR INSTALLING AT LEAST ONE MOORING LINE OF A FLOATING INSTALLATION IN A BODY OF WATER AND ASSOCIATED FLOATING INSTALLATION

CROSS-REFERENCE TO RELATED APPLICATIONS

This application is a U.S. National Stage filed under 35 U.S.C. § 371, based on International PCT Application No. PCT/EP2021/070410, filed on Jul. 21, 2021, which claims priority to French Application FR2007698 filed on Jul. 22, 2020 in the French Patent Office. The entire contents of these applications are incorporated herein by reference in their entirety.

BACKGROUND OF THE INVENTION

The present invention relates to a method of placing at least one mooring line of a floating installation in a body of water, the method comprising the following steps:

- installing at least one lower section of a mooring line in a ground at the bottom of the body of water;
- trapping of the lower section in the ground;
- connecting an upper unit of the floating installation to the mooring line.

The floating installation is e.g. a floating platform on the body of water, intended for the production of energy, or for the recovery, the treatment and/or the storage of fluids, in particular hydrocarbons. In a variant, the floating installation is a floating installation for the production of renewable energy, in particular for the production of wind or tidal energy. In a variant, the floating installation is an aquaculture installation or a marine signaling installation.

Such installations, comprising a surface unit floating on a body of water, generally have to be firmly moored to the bottom of the body of water. The above prevents the installations from moving under the effect of the many external forces to which the installations are subjected. The forces include wind, waves, swell and/or sea currents.

The mooring has to be robust, even when the water is deep. The mooring is generally achieved by placing mooring points on the bottom of the body of water connected to mooring lines resting on the bottom of the body of water, by moving the mooring lines up to the surface unit, and then extending the mooring lines from the surface unit.

The mooring lines consist of cables (either steel or synthetic) or/and chains and, at the lower end of the mooring line, at least one mooring point formed by an anchor or a pile which hooks into the ground at the bottom of the body of water.

A first mooring technology consists of using a dragging anchor, which hooks into the ground at the bottom of the body of water.

To obtain a satisfactory hooking of the anchor, and hence a sufficient resistance to tension on the mooring lines, it is necessary to place the anchor on the bottom of the body of water, then to pull the anchor using e.g. a laying vessel. Thus, the dragging anchor sinks into the bottom of the body of water, and opposes sufficient resistance to traction.

Hence, such anchors are effective, but often lead to inaccurate positioning of the floating installation. Indeed, it is necessary to set the anchor initially at a position away from the final position desired for the anchor, then to pull it on the bottom of the body of water over a certain distance. The distance can be estimated but varies significantly depending on the obstacles and/or the nature of the bottom of the body of water, and on the ability of the anchor to penetrate the ground without skidding on the ground. The final position of the anchor is thus sometimes significantly different from the position initially desired.

To overcome such problem, when a more precise installation is required, it is known how to use suction piles, batter piles, drilled shafts or torpedo piles. After installation, the pile is permanently held in the ground.

Suction piles are pushed-in into the ground at a desired mooring point. Then, a vacuum is created inside the suction pile, so as to block the pile in position in the bottom of the body of water.

Such mooring methods are precise, but very expensive, since they require the intervention of divers and/or remote-controlled vehicles, e.g. for carrying out the suction. Such methods have constraints related to the depth of water e.g. the installation of suction piles or torpedo piles.

Batter piles are positioned in the ground, and generally have to be held upright with a piling guide. A hammer and a piling cap are then installed on the piles and repeated shocks are applied.

Such method is also very expensive and causes strong environmental nuisances by the use of the guide and of the hammer, and by the noise and the vibrations caused by the piling.

Torpedo piles are also difficult to install and require a minimum depth of water in order to be projected at high speed towards the bottom of the body of water so as to sink enough into the bottom of the body of water.

U.S. Pat. No. 5,992,060 describes another type of mooring pile installed by a method of the aforementioned type. In such method, an anchor located at the end of a mooring line is lowered into the ground at the bottom of the body of water, by means of a pile.

Once the anchor is lowered, the pile is removed and a traction on the mooring line wedges the anchor which deploys perpendicular to the traction force so as to provide high resistance to traction.

Such a pile is positioned in a more precise way than a conventional traction anchor. However, the pile requires an anchor located at each end of the mooring line, which increases the cost. Furthermore, the deployment of the anchor from the pile is not always reliable.

An aim of the invention is thus to obtain a method for mooring a floating installation in a precise and very robust way, the method being nevertheless less expensive and more reliable than the existing methods.

SUMMARY OF THE INVENTION

To this end, the subject matter of the invention is a method of the aforementioned type, characterized in that the lower section of the mooring line consists of a chain, the chain delimiting, after the coupling of the upper unit, a lower end of the mooring line devoid of pre-mounted mooring point on the mooring line, in particular devoid of anchor or of pile.

The method according to the invention can comprise one or a plurality of the following features, taken individually or according to any technically possible combination:

- the lower section is placed in the ground over a depth and/or a length chosen so that once the upper unit is coupled to the mooring line, at least the tension applied to the lower end is zero;
- the trapping of the lower section in the ground involves pulling the lower section so as to move the lower section from a first sinking configuration which is advantageously linear, in particular vertical or horizontal, to a second trapping configuration, which is advantageously in the form of a catenary;

the lower section is fitted with at least one connector, the coupling of the upper unit to the mooring line comprising the connection of an upper section of the mooring line to the connector and the tensioning of the upper section from the upper unit or from an installation vessel;

the installation of the lower section in the ground involves the joint lowering into the ground of a caisson and of the lower section, the method then comprising the separation of the caisson from the lower section, then the raising of the caisson out of the ground, the lower section remaining in the ground;

the joint lowering into the ground of the caisson and of the lower section takes place along a vertical or substantially vertical axis;

the caisson defines at least one longitudinal channel in the external surface thereof, the lower section being located in the longitudinal channel during the joint lowering into the ground of the caisson and of the lower section;

the separation step involves lowering a length of chain of the lower section under the caisson so as to form an accumulation of chain under the caisson delimiting the lower end;

it comprises the casting of a sealing compound and the solidification of the sealing compound under the caisson after the combined lowering into the ground of the caisson and of the lower section or/and the placement of additional sedimentary material, in particular sand and/or gravel, instead of the volume occupied by the caisson, after raising the caisson;

the combined lowering into the ground of the caisson and of the lower section comprises the spraying of a liquid under pressure under the caisson;

the combined lowering into the ground of the caisson and of the lower section comprises the injection of a gas or a fluid into the caisson and/or around the caisson so as to raise the solids excavated by the caisson;

it comprises the installation of a plurality of lower sections of a plurality of mooring lines in the ground, the lower sections of at least two mooring lines being jointly lowered with the same caisson.

the installation of the lower section in the ground involves the placement of a chain in a horizontal trench in the ground, the trapping of the lower section involving pulling at least one end of the chain so as to move the chain from a first linear configuration to a second configuration different from the first configuration, in particular a second curved configuration, and the connection of at least one end of the chain to an upper section of the mooring line coupled to the upper unit;

it comprises the traction of both ends of the chain so as to form two lower sections of two respective mooring lines trapped into the ground, the mooring lines having a common lower end, the procedure involving the connection of each end of the chain to an upper section of a respective mooring line coupled to the upper unit, or to another upper unit;

the lower end of the mooring line is devoid of coupling to an anchor or to a pile;

the lower end of the mooring line is devoid of mooring point when the lower section of the mooring line is placed into the ground at the bottom of the body of water.

The invention further relates to a floating installation in a body of water, comprising an upper unit and at least one mooring line coupled to the upper unit, the mooring line including a lower section sunk and trapped into a ground at the bottom of the body of water; characterized in that the lower section of the mooring line consists of a chain, the chain delimiting, after the coupling of the upper unit, a lower end of the mooring line devoid of mooring point premounted on the mooring line, in particular devoid of anchor or of pile.

DESCRIPTION OF THE FIGURES

The invention will be better understood upon reading the following description, given only as an example and making reference to the enclosed drawings, wherein.

DETAILED DESCRIPTION

Figure 1:
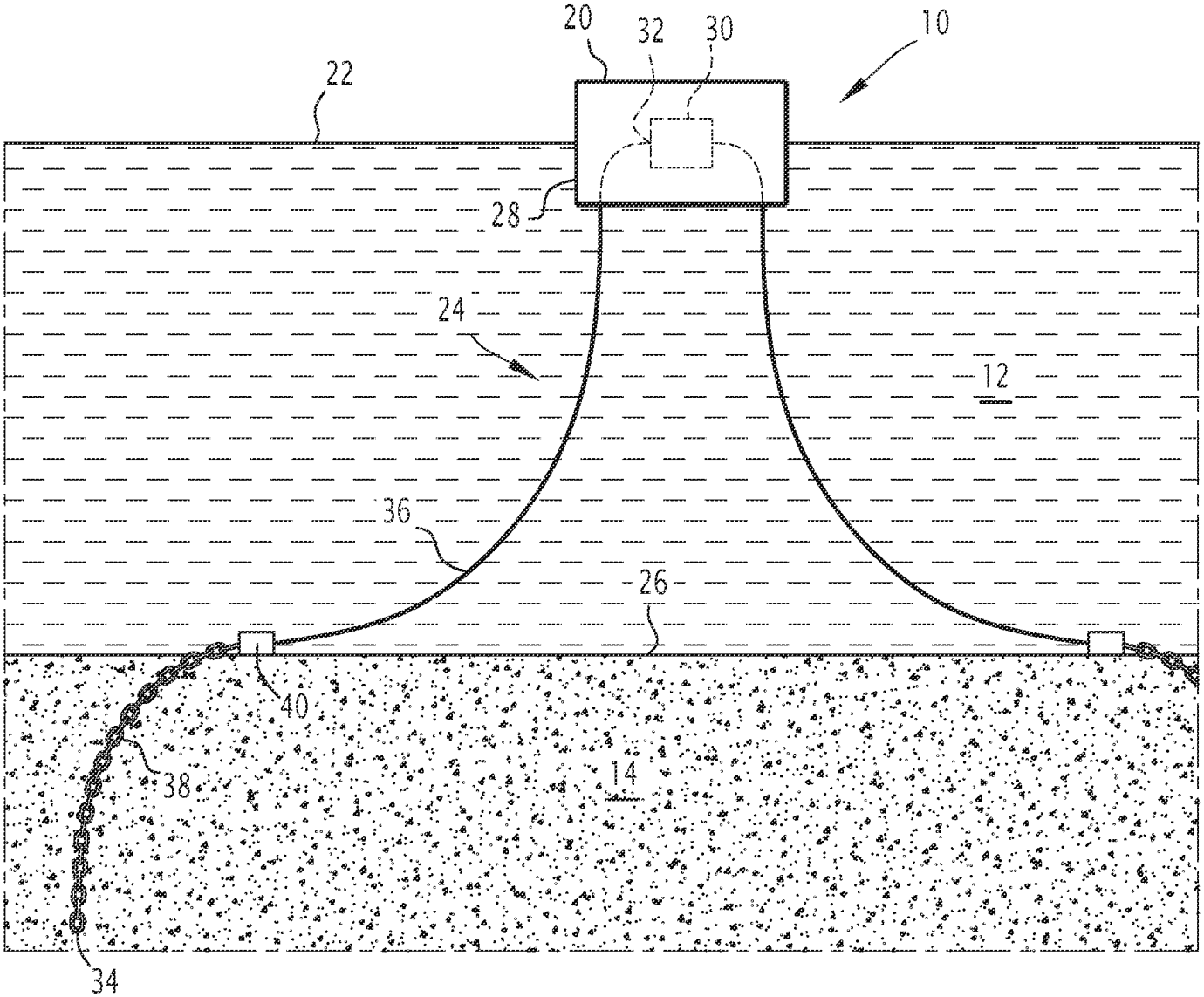
FIG. 1 is a schematic view of a first floating installation set up following a method according to the invention.
Figure 2:
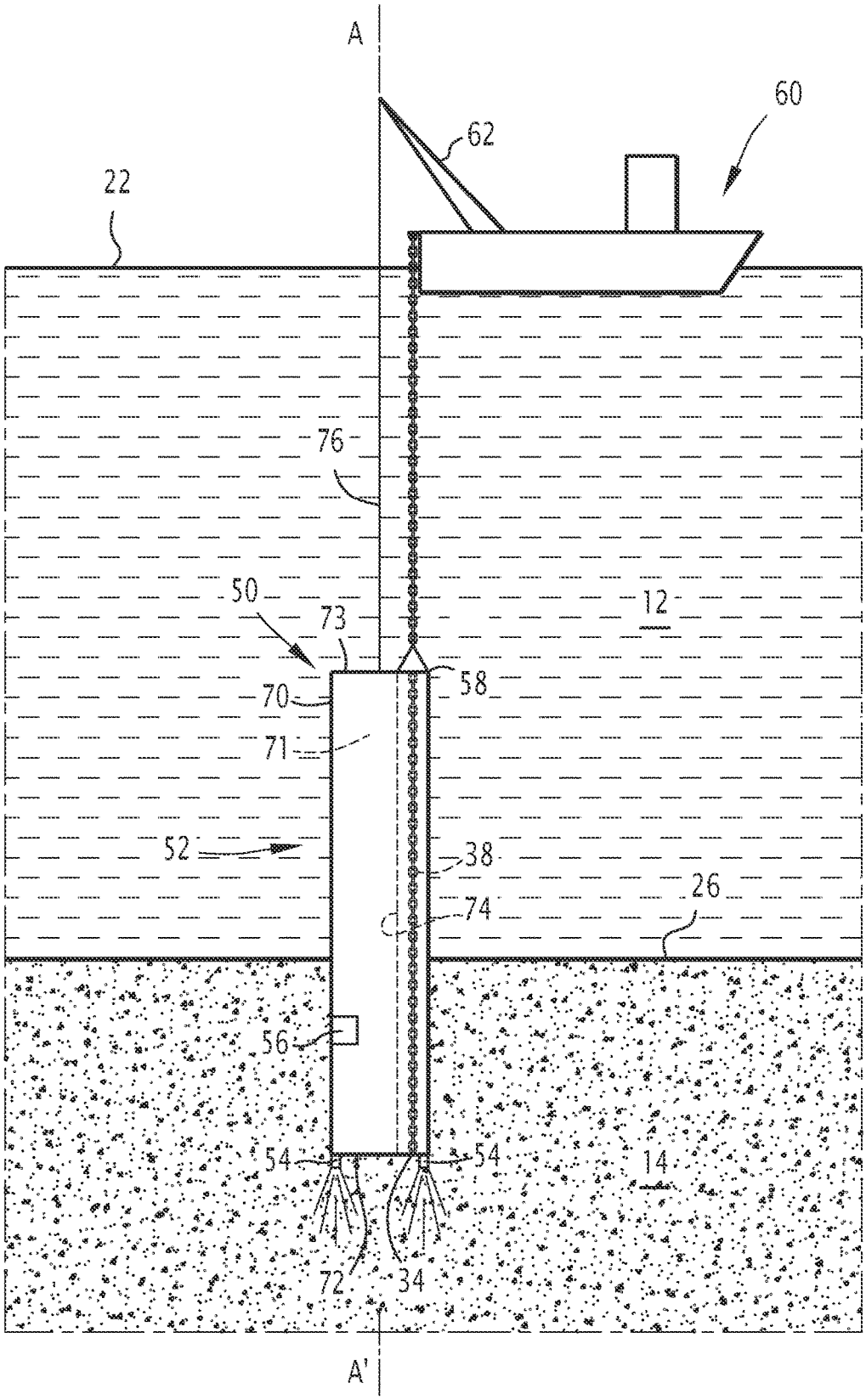
FIG. 2 is a view similar to FIG. 1, during a first step of the method for installing a mooring line according to the invention.

A first installation method according to the invention is intended for mooring a floating installation 10 shown schematically in FIG. 1.

The floating installation 10 is arranged in a body of water 12. The body of water 12 is e.g. an ocean, a sea, a lake or a river.

The body of water 12 rests on loose soil 14 including sediment.

The floating installation 10 is e.g. a floating installation for the production of energy, in particular renewable energy. It comprises e.g. wind turbines and/or tidal stream generators.

As a variant, the floating installation 10 is a floating installation for handling fluids, in particular a Floating Production, Storage and Offloading unit called FPSO, a floating unit dedicated to liquefied natural gas called FLNG (Floating Liquefied Natural Gas), a semi-submersible platform, a Tension Leg Platform called TLP, a discharge buoy, a floating vertical column or a vessel.

In a variant, the floating installation 10 is a floating aquaculture installation intended e.g. for fish farming or the production of algae, a maritime signaling installation, e.g. a floating lighthouse, or any other floating system requiring position keeping by means of a passive system.

The floating installation 10 includes an upper unit 20, which, in this example, is a surface unit floating on the surface 22 of the body of water 12.

The floating installation 10 further includes a plurality of mooring lines 24 of the upper unit 20, coupling the upper unit 20 to the bottom 26 of the body of water 12.

In such example, the upper unit 20 includes at least one hull 28 floating on the body of water 12 and at least one device 30 for tensioning the mooring lines 24, suitable for generating a tension on the mooring lines 24, in order to hold the upper unit 20 in position in the body of water 12.

The upper unit 20 carries e.g. at least one energy production equipment (either electric or fossil), in particular a wind turbine or a tidal stream generator, or at least one unit for the production, collection, storage and/or the treatment of fluid, in particular hydrocarbons recovered from the ground 14 at the bottom 26 of the body of water 12. As a variant or in addition, the upper unit carries equipment for feeding and/or treating aquatic fauna, or aquatic plants, equipment for light or electromagnetic signaling, and/or measuring sensors, in particular meteorological sensors.

In the case of a production, collection, storage and/or a treatment unit for fluid, the upper unit 20 is also coupled to the bottom 26 of the body of water 12 via fluid transport pipes, in particular flexible or rigid fluid transport pipes named by the term "riser".

As illustrated in FIG. 1, each mooring line 24 extends through the body of water 12 from an upper end 32 mounted rigidly attached to the upper unit 20 to a lower end 34 devoid of mooring point pre-mounted on the mooring line 24. The lower end 34 is arranged in the solid ground 14 under the bottom 26 of the body of water 12. Each mooring line 24 operates in a substantially vertical plane defined by the geometry thereof.

"Devoid of mooring point pre-mounted on the mooring line 24" means that no mooring point, such as an anchor or a pile, is assembled on the mooring line 24 prior to the installation thereof in the ground 14, and that no mooring point such as an anchor or a pile is present when the mooring line is placed in the ground 14.

In the present example, as will be seen below, the mooring line 24 is devoid of mooring point, in particular of a permanent anchor, or of an attachment pile at the lower end 34 thereof furthest from the upper unit 20.

In the example illustrated in FIG. 1, the mooring line 24 thus comprises an upper section 36 extending through the body of water 12 as far as the bottom 26 of the body of water 12, and a lower section 38, at least partially inserted into the ground 14 and resting partially on the bottom 26 of the body of water 12.

The mooring line 24 advantageously further comprises a connector 40 coupling the upper section 36 to the lower section 38 on the bottom 26 of the body of water 12 or above the latter.

The upper section 36 is made e.g. of a combination of chains and/or cables. It extends in a chain formation between the bottom 26 of the body of water 12 and the upper end 32 of the mooring line 24.

The lower section 38 consists of a chain. The chain is formed of interconnected links which extend to the lower end 34. Thus, the lower end 34 which is the point furthest from the upper unit 20 when the upper unit 20 is coupled to the mooring line 24, consists of a link of the chain forming the lower section 38.

No mooring element nor pile is attached to the lower end 34 of the lower section 38. As will be seen below, the lower end 34 can be situated at a local accumulation 80 of chain links of the lower section 38, possibly solidified by a sealing compound, such as a cement.

Advantageously, to keep the floating installation 10 in position, the length of the lower section 38 inserted and held in the ground 14 and/or the depth of the lower end 34 in the ground 14 are calculated so that at least the tension at the lower end 34 is zero when the floating installation 10 is coupled to the mooring line 24.

Figure 9:
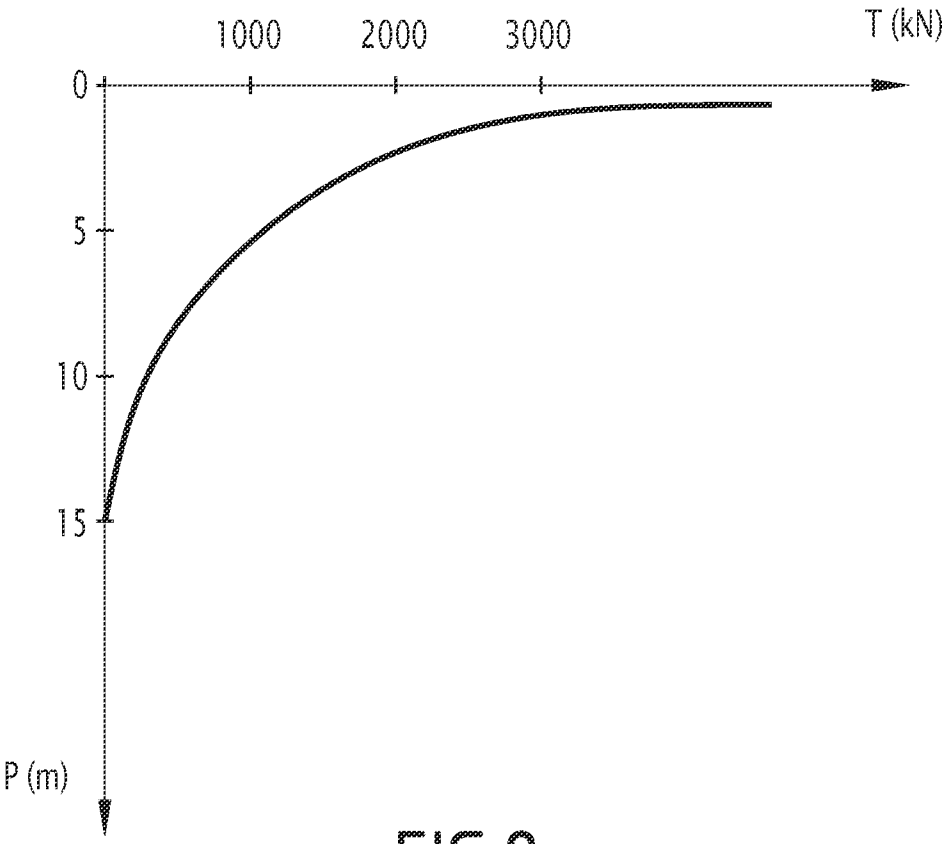
FIG. 9 is a curve showing the tension applied to the mooring line as a function of depth.

The length of chain suitable for forming the lower section 38 is calculated prior to the installation of the floating installation 10, by simulating the tension extending along the chain, depending on the structure of the upper unit 20, the depth, the value of the tension and the direction thereof at the ground surface, as illustrated by FIG. 9 which shows the evolution of the tension in the chain depending on the depth in the ground.

The calculation is performed e.g. using a simulation software. In FIG. 9, it is noted e.g. that the tension is canceled when the depth is greater than 15 m. The length of chain trapped in the ground 14 is thus chosen to be greater than 15 m, with a safety margin so as to ensure zero tension at the lower end 34 once the upper unit 20 has been coupled to the mooring line 24.

The chain length is comprised e.g. between 10 m and 100 m, it is generally greater than 20 m for tensions on the order of 500 tons.

In the ground 14, the lower section 38 extends in the form of a catenary, between the lower end 34 wherein the tangent to the lower section above the chain accumulation 80 is vertical or inclined by less than 30° with respect to the vertical and the point of coupling to the connector 40, wherein the tangent to the lower section 38 is horizontal or inclined at an angle of less than 450 with respect to the horizontal in the case of an un-tensioned mooring with the mooring line 24 in the form of a catenary. In a variant, for a tensioned mooring, e.g. for platforms with tensioned lines, the tangent at the coupling point is vertical or inclined at an angle of less than 10° with respect to the vertical.

It should be noted that the absence of a mooring point, in particular of an anchor or a pile at the lower end 34 of the chain, simplifies the structure of the mooring line 24, and significantly reduces the cost thereof compared to a mooring line 24 coupled to a suction pile.

Such absence of anchor, compensated for by a greater length of the lower section 38, nevertheless provides a very high stability of the mooring line 24 in response to the tension stresses applied to the mooring line. The upper unit 20 thus remains firmly moored in the body of water 12.

The installation of the mooring line 24 is implemented using an installation unit 50 shown schematically in FIGS. 2 to 5.

The installation unit 50 includes at least one guiding system, which can be a caisson 52, intended to guide at least one lower section 38 into the ground 14, at least one liquid spraying device 54 for sinking the caisson 52 into the ground 14 and, if appropriate, a device 56 for injecting fluid, in particular gas or water, for facilitating the discharge of materials coming from soil erosion, by means of the devices 54, which were discharged during the insertion of the caisson 52.

The installation unit 50 further includes a releasable attachment device 58 between the caisson 52 and the or each lower section 38.

The installation unit 50 further comprises a laying vessel 60 equipped with at least one crane 62.

With reference to FIGS. 2 to 5, the caisson 52 includes a hollow tubular wall 70 extending herein along a longitudinal axis A-A'. The longitudinal axis A-A' is intended to be vertical when the caisson 52 is inserted into the ground 14.

The hollow tubular wall 70 delimits a central passage 71 with an axis A-A', open at least at the lower end 72 thereof, and advantageously also at the upper end 73 thereof.

Figure 5:
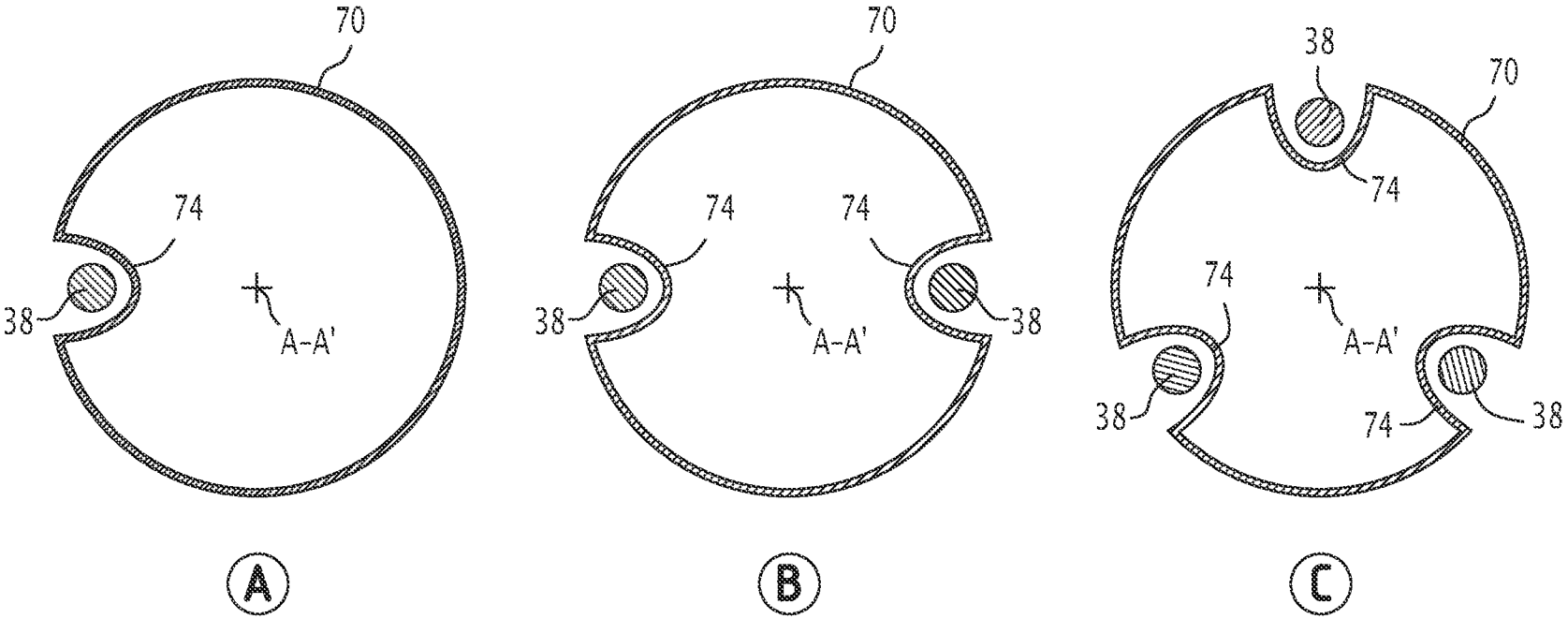
FIG. 5 describes variants of caissons intended for the installation method according to the invention, for the simultaneous installation of a plurality of mooring lines.

As illustrated in FIG. 5, the hollow tubular wall 70 defines externally at least one channel 74 for receiving the lower section 38 of the mooring lines extending parallel to the longitudinal axis A-A'.

The hollow tubular wall 70 defines e.g. only one channel 74 as can be seen in FIG. 5A or a plurality of channels 74, each containing a lower section 38 of a distinct mooring line 24, as illustrated in FIGS. 5B and 5C.

The channel 74 is set back internally towards the longitudinal axis A-A'. The channel opens radially outwards and also at the longitudinal ends 72, 73 of the hollow tubular wall 70.

The hollow tubular wall 70 is e.g. made of metal. The length thereof is advantageously greater than 10 m, and in particular comprised between 8 m and 30 m. In the present example, the maximum transverse extent, taken perpendicular to the axis A-A' thereof, is less than 1 m.

The external cross-section of the caisson 52 is thus constant over substantially the entire height of the caisson 52. Said section has herein a circular contour between each channel 74. In a variant, the section has a polygonal (e.g. a rectangle or triangle) or an elliptical outer contour.

The liquid spraying devices 54 are located at the lower end of the caisson 52. They are suitable for spraying liquid, e.g. water, beyond the lower end 72 so as to enable the caisson 52 to advance by sinking into the ground 14.

The fluid injection device 56, when present, is able to inject a gas or a fluid, e.g. air or water through the central passage 71 delimited by the hollow tubular wall 70 of the caisson 52 and/or into the channels 74 so that it can be released, and the sediment column can be made lighter through the central passage 71.

The attachment device 58 is able, in an active configuration, to rigidly attach one point of the lower section 38 to the caisson 52. In the example shown in FIG. 2, the attachment device 58 is located in the vicinity of the upper end 73. In a variant or in addition, an attachment device 58 is located in the vicinity of the lower end of the caisson 52.

It is suitable, upon command from an operator, to move into an inactive configuration, in order to separate the lower section 38 from the hollow tubular wall 70.

In the active configuration of the attachment device 58, the lower section 38 is thus lowered jointly with the caisson 52, when the caisson 52 is sunk into the ground 14.

In the inactive configuration, the caisson 52 is suitable for being extracted from the ground 14, independently of the lower section 38 which remains in position in the ground 14.

The crane 62 of the laying vessel 60 includes at least one lowering line 76 for carrying the caisson 52 and the lower section 38 rigidly attached to the caisson 52 to a predetermined insertion point on the bottom 26 of the body of water 12, then for controlling the joint lowering of the caisson 52 and of the lower section 38 into the bottom 26, when the caisson 52 is sunk in.

The lowering line 76 is further suitable for raising of the caisson 52 out of the ground 14, then through the body of water 12 after the lower section 38 has been positioned in the ground 14 and has been separated from the caisson 52.

A first installation method according to the invention, implemented using the installation unit 50, will now be described.

Initially, the lower section 38, consisting of a chain and devoid of anchor or pile, is supplied to the laying vessel 60 and is attached to the caisson 52 by means of the attachment device 58.

The caisson 52 is immersed by being hooked to the end of the line 76. The lower section 38 extends partially in the channel 74 parallel to the vertical longitudinal axis A-A' of the caisson 52.

The caisson 52 is then lowered to the desired mooring point on the bottom 26 of the body of water 12. The liquid spraying devices 54 are activated for progressive lowering of the caisson 52 along a vertical axis, or substantially vertical axis, e.g. inclined with respect to the vertical by an angle of less than 30°.

Advantageously, when present, the fluid injection device 56 is also activated so as to facilitate the rise of the sediments excavated by the caisson 52 into the central passage 71 and/or to clear the channels 74 so as to allow the lower section 38 to be lowered without any obstacle.

The lowering continues to the calculated depth at which the lower end 34 of the mooring line 24 formed by the lower end of the lower section 38 devoid of mooring point premounted on the mooring line, in particular no anchor nor pile, must be situated.

Figure 3:
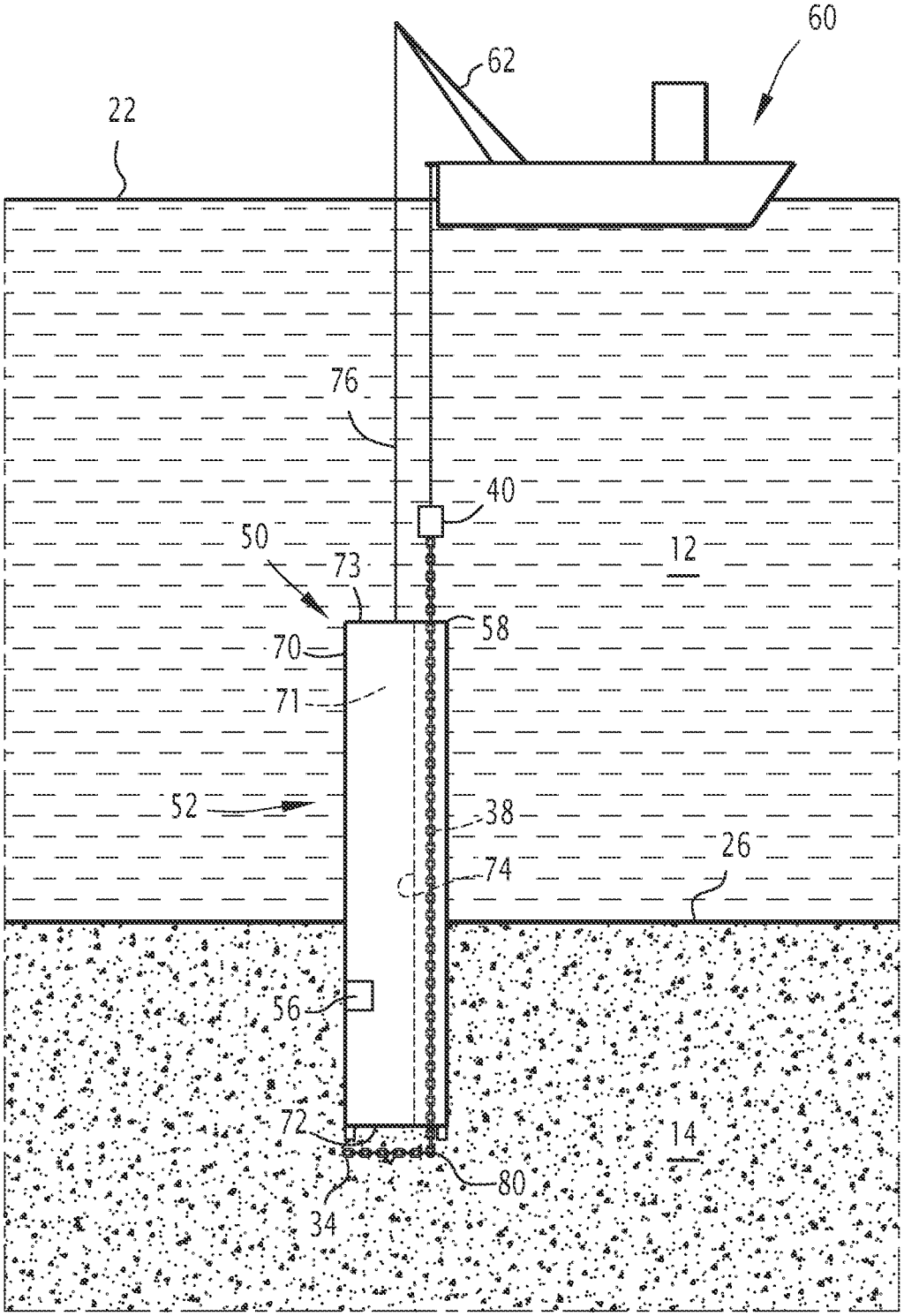
FIG. 3 is a view similar to FIG. 2, during a second step of the installation method.
Figure 4:
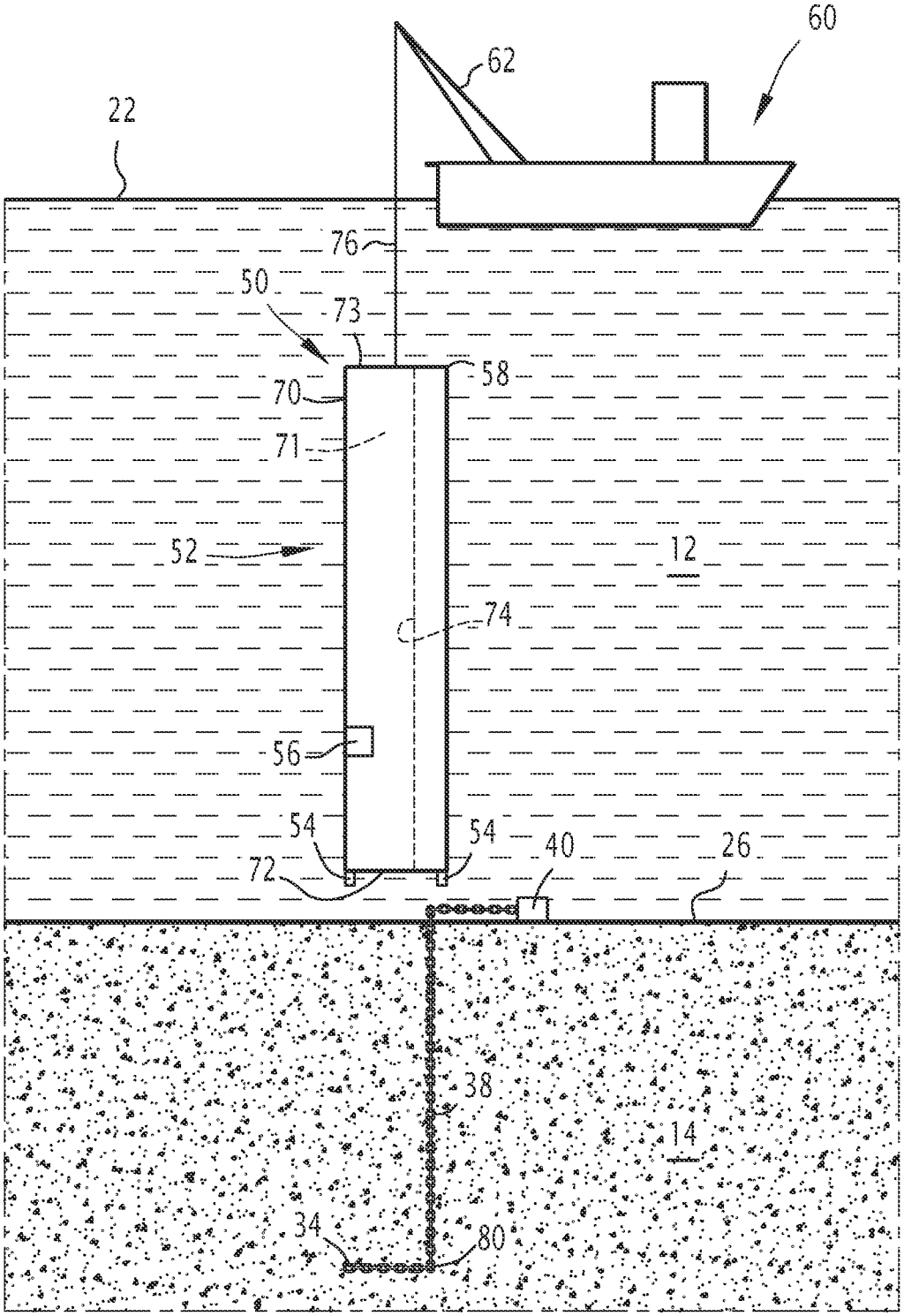
FIG. 4 is a view similar to FIG. 2, during a third step of the installation method.

When said depth is reached, as illustrated in FIG. 3, the attachment device 58 is released and a length of chain is optionally lowered under the caisson 52 so as to form a local accumulation 80 of chain in the vicinity of the lower end 34.

If appropriate, a sealing material is brought through the channel 74 and/or through the central passage 71 so as to solidify around the accumulation 80.

The connector 40 located at the upper end of the lower section 38 is then placed on the bottom 26 of the body of water 12.

The crane 62 is then activated for raising the line 76 and for extracting the caisson 52 from the ground 14. Since the lower section 38 is arranged in the channel 74, the raising of the caisson 52 does not affect the vertical positioning thereof in the ground 14, and does entail the rise thereof, jointly with the caisson 52.

Once the caisson 52 has been extracted and raised above the ground 14, the connector 40 is then coupled to a traction line (not shown) which is e.g. attached to the laying vessel 62 or to a traction device (not shown) located in the body of water 12. Traction is applied to the connector 40 to move it away from the initial point of insertion of the lower section 38 into the ground 14 and to make the lower section move into the configuration in the form of a catenary shown in FIG. 1. The lower section is then trapped in the ground 14.

Such trapping results from friction with the sediment present in the soil 14, so as to overcome the traction forces applied to the connector 40. The trapping also results from the weight of the sediment located above the line 38, which is able to resist the traction on the connector 40.

The upper section 36 of the mooring line 24 is then coupled to the connector 40, and is raised towards the tensioning device 30 on the upper unit 20.

The tensioning device 30 is then activated for tensioning the mooring line 24.

The steps for the installation of the mooring line 24 are thus particularly simple, since it is not necessary to move an anchor in the ground 14 in order to moor the anchor in a robust manner requiring the deployment of significant traction forces. The length of chain inserted into the ground 14 is sufficient as such for achieving the mooring and withstanding the traction forces.

Furthermore, the positioning of the mooring line 24 is very precise and corresponds to a predetermined location before the installation of the floating installation 10. Precision is provided by the use of a caisson 52 which lowers the lower end 34 to the desired point, in depth and in position.

Furthermore, compared with a suction pile, it is not necessary to suck the inside of the caisson 52, which makes it possible to dispense with the usual restrictions in shallow depths. Thereby, the caisson 52 can be reused for laying other mooring lines 24. Costs are in this way minimized, without compromising the precision and the robustness of the mooring.

In the example described above, a tensioning device 30 is provided on the upper unit 20, the upper end 32 of the mooring line 24 being mounted rigidly attached to the tensioning device 30. In a variant, the lengths of the mooring lines 24 are known in advance. The presence of a tensioning device 30 on the upper unit 20 becomes optional.

A tensioning device 30 is then advantageously provided on an installation vessel 60 and is common to the entire field.

In another variant, the method comprises the installation of additional sedimentary material, in particular sand and/or gravel, instead of the volume occupied by the caisson 52 after the raising of the caisson 52.

Figure 6:
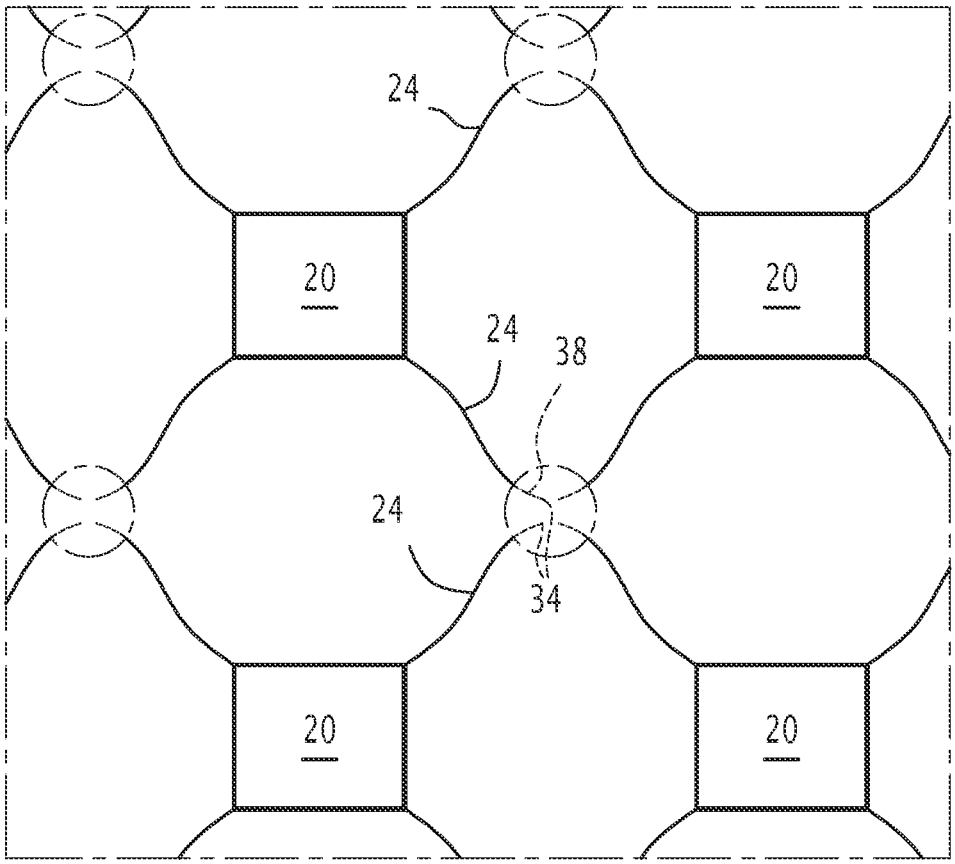
FIG. 6 is a top view of a variant of floating installation installed by a method according to the invention.

In the variant shown in FIGS. 5, variant (B), and variant (C) and FIG. 6, the caisson 52 houses a plurality of lower sections 38 of distinct mooring lines 24, which are inserted simultaneously into the ground 14.

In this way it is possible to place a plurality of mooring lines 24 almost simultaneously at substantially the same mooring point.

Thereby, it is possible, at a lower cost, to moor in a close and precise manner, a plurality of adjacent upper units 20 from the same mooring point, in an inexpensive and robust way, as illustrated in FIG. 6.

In the present example, at least two adjacent upper assemblies 20 are coupled to the bottom 26 by mooring lines 24 the lower end 34 of which is located substantially at the same insertion point in the ground 14, having been installed by the same caisson 52.

Figure 7:
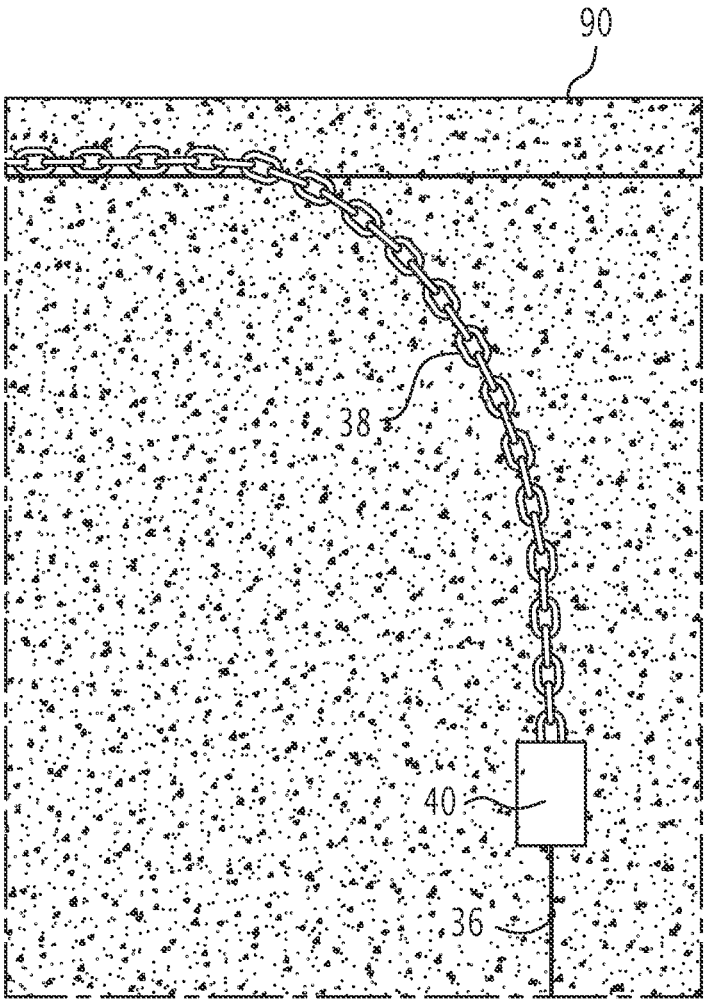
FIG. 7 is a top view illustrating another embodiment of the installation method according to the invention.

In the variant implemented in FIG. 7, the chain of the lower section 38 is inserted into the ground 14 substantially horizontally, e.g. into a trench 90 made in the ground 14, by means of an excavation device (not shown), such as a bottom plow or a water jet cutting system.

The depth of the trench 90 is e.g. greater than 1 m and, in particular, comprised between 1 m and 3 m.

The above being done, traction is applied to the connector 40 by a traction unit, as described above, so as to move it from a horizontal linear configuration in the trench 90 to a horizontal configuration in the form of a chain, taken in projection in a horizontal plane, wherein the lower section 38 is trapped in the ground 14.

The connector 40 is then coupled to the upper section 36 as described above.

Figure 8:
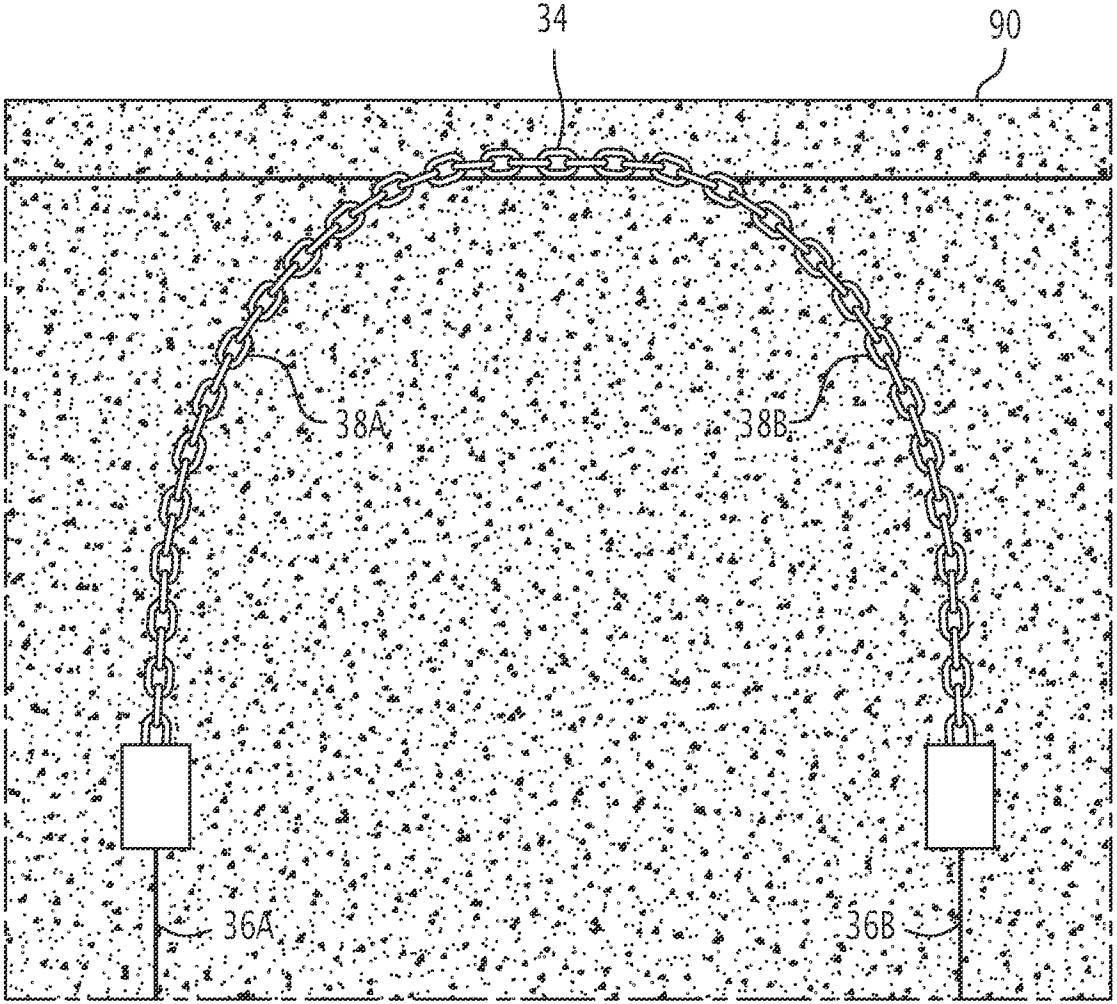
FIG. 8 is a top view illustrating another implementation of the installation method according to the invention.

In the variant shown in FIG. 8, the two ends of a length of chain are each provided with a connector 40.

The connectors 40 are each pulled away from the initial position thereof so as to form two lower sections 38A, 38B having a common lower end 34 located at the point furthest from the connectors 40 and hence from the or each upper unit 20.

Each lower section 38A, 38B is then connected to an upper section 36A, 36B so as to form a mooring line.

In another variant, the upper unit 20 is a totally submerged unit which floats away from the bottom 26 of the body of water 12.

The invention claimed is:

1. A method of placing at least one mooring line of a floating installation in a body of water, the method comprising:

installing at least one lower section of a mooring line in a ground at a bottom of the body of water;

trapping the at least one lower section in the ground;

coupling an upper unit of the floating installation to the mooring line;

the at least one lower section of the mooring line consisting of a chain, the chain delimiting, after the coupling of the upper unit, a lower end of the mooring line devoid of mooring point pre-mounted on the mooring line, wherein trapping the at least one lower section in the ground includes placing the at least one lower section in the ground over a depth and/or a length chosen such that after coupling the upper unit to the mooring line, at least the tension applied to the lower end of the mooring line is zero, and wherein a chain length of the lower section is calculated prior to installation by simulating a tension extending along the chain, as a function of the upper assembly, a depth of the lower end in the ground, a value of the tension at the lower end, and a direction of the lower section at ground level.

2. The method according to claim 1, wherein trapping the at least one lower section in the ground comprises pulling the at last one lower section to move the at least one lower section from a first penetrating configuration to a second trapping configuration.

3. The method according to claim 2, wherein the first penetrating configuration is linear, the second trapping configuration being in the form of a catenary.

4. The method according to claim 1, wherein the at least one lower section is provided with at least one connector, coupling the upper unit to the mooring line comprising connecting an upper section of the mooring line to the at least one connector and tensioning the upper section from the upper unit or from an installation vessel.

5. The method according to claim 1, wherein trapping the at least one lower section in the ground comprises jointly lowering into the ground a caisson and the at least one lower section, the method further comprising separating the caisson from the at least one lower section, then raising the caisson out of the ground, the at least one lower section remaining in the ground.

6. The method according to claim 5, wherein the joint lowering into the ground of the caisson and of the at least one lower section takes place along a vertical or substantially vertical axis.

7. The method according to any of claim 6, wherein the caisson defines at least one longitudinal channel in the external surface thereof, the at least one lower section being located in the longitudinal channel during the joint lowering into the ground of the caisson and of the at least one lower section.

8. The method according to claim 6, wherein separating the caisson from the at least one lower section comprises lowering a length of chain from the at least one lower section under the caisson to form an accumulation of chain under the caisson, the accumulation of chain delimiting the lower end.

9. The method according to claim 6, comprising casting a sealing compound and solidifying the sealing compound under the caisson after the joint lowering into the ground of the caisson and of the at least one lower section or/and placing additional sedimentary material, instead of the volume occupied by the caisson after raising the caisson out of the ground.

10. The method according to claim 6, wherein the joint lowering into the ground of the caisson and of the at least one lower section comprises spraying a liquid under pressure under the caisson.

11. The method according to claim 6, wherein the joint lowering into the ground of the caisson and of the at least one lower section comprises injecting a gas or a fluid into the caisson and/or around the caisson, to lift solids excavated by the caisson.

12. The method according to claim 6, comprising installing a plurality of lower sections of a plurality of mooring lines in the ground, the lower sections of at least two mooring lines being lowered together with the same caisson.

13. The method according to claim 1, wherein installing at least one lower section of a mooring line in a ground comprises placing a chain in a horizontal trench in the ground, trapping the lower section, the trapping of the lower section including pulling at least one end of the chain to move the chain from a first linear configuration to a second configuration different from the first configuration and connecting at least one end of the chain to an upper section of the mooring line coupled to the upper unit.

14. The method according to claim 13, wherein the chain has two ends, the method comprising pulling the two ends of the chain to form two lower sections of two respective mooring lines trapped in the ground, the mooring lines having a common lower end, the method comprising connecting each end of the chain to an upper section of a respective mooring line coupled to the upper unit, or to another upper unit.

15. The method according to claim 13, wherein the second configuration is a curved configuration.

16. The method according to claim 1, wherein the lower end of the mooring line is devoid of an anchor or of a pile.

17. A floating installation in a body of water, comprising:

an upper unit and at least one mooring line coupled to the upper unit, the mooring line including an upper section operatively connected to the installation and a lower section coupled to the upper section via a connector configured to rest on the bottom of a body of water, wherein the lower section is penetrating and trapped in the ground at the bottom of the body of water;

the lower section of the mooring line consisting of a chain, the chain delimiting, after the coupling of the upper unit, a lower end of the mooring line devoid of mooring point pre-mounted on the mooring line, wherein with the lower section trapped, the lower section extends in the form of a catenary between the lower end of the chain and the connector.

18. The installation of claim 17, wherein a tangent to the lower section catenary section is vertical or inclined by less than 30° with respect to the vertical.

19. A method of placing at least one mooring line of a floating installation in a body of water, the method comprising:

installing at least one lower section of a mooring line in a ground at a bottom of the body of water, the lower section of the mooring line coupled to an upper section of the mooring line via a connector;

trapping the at least one lower section in the ground by applying traction to the connector to move the lower section into a catenary while the lower section remains in the ground;

coupling an upper unit of the floating installation to the mooring line via the connector, the at least one lower section of the mooring line consisting of a chain, the chain delimiting, after the coupling of the upper unit, a lower end of the mooring line devoid of mooring point pre-mounted on the mooring line, wherein the lower section is configured such that friction between the lower section and sediment present in the ground and a weight of the sediment located above the lower section resists and overcomes traction forces applied to the connector thereby trapping the lower section in the ground.

* * * * *